US005152843A

United States Patent [19]

McDonald et al.

[11] Patent Number: 5,152,843

[45] Date of Patent: Oct. 6, 1992

[54] METHOD FOR REMOVAL HOT WATER HEATER SEDIMENT

[76] Inventors: George N. McDonald, 73 Rossford Crescent, Kitchener, Ontario, Canada, N2M 2H8; Daniel G. McDonald, McKenzie Road, Gardiner Mines, Nova Scotia, Canada, B1H 4K2

[21] Appl. No.: 730,443

[22] Filed: Jul. 16, 1991

[51] Int. Cl.[5] ..... B08B 3/02; B08B 9/093

[52] U.S. Cl. ..... 134/22.1; 134/21; 134/22.12; 134/18; 134/24; 122/380; 122/379; 122/382; 122/390; 122/405

[58] Field of Search ..... 134/21, 22.1, 22.12, 134/18, 24; 122/380, 379, 382, 390, 405

[56] References Cited

U.S. PATENT DOCUMENTS 1,767,919 6/1930 Eiermann ..... 122/405
1,768,039 6/1930 Eiermann ..... 122/405
4,714,053 12/1987 Perry ..... 122/382
4,858,563 8/1989 Perry ..... 122/382
5,011,537 4/1991 Voegele et al. ..... 134/22.11

*Primary Examiner*—Theodore Morris
*Assistant Examiner*—Zeinab El-Arini
*Attorney, Agent, or Firm*—R. Craig Armstrong

[57] ABSTRACT

Sediment can be removed from hot water heaters via the method and apparatus of the invention. The tank is drained and the drain tube is used for access to the bottom of the tank. Water jet probes connected via a hose to a water supply are inserted through the drain valve opening, and are directed in such a way that the sediment is forced into suspension and runs out of the tank through the drain tube, around the probe. Preferably, the water and sediment drain into a pan, and preferably a pump is provided to pump water from the pan to a drain or other remote discharge location.

9 Claims, 5 Drawing Sheets

FIG. 8.
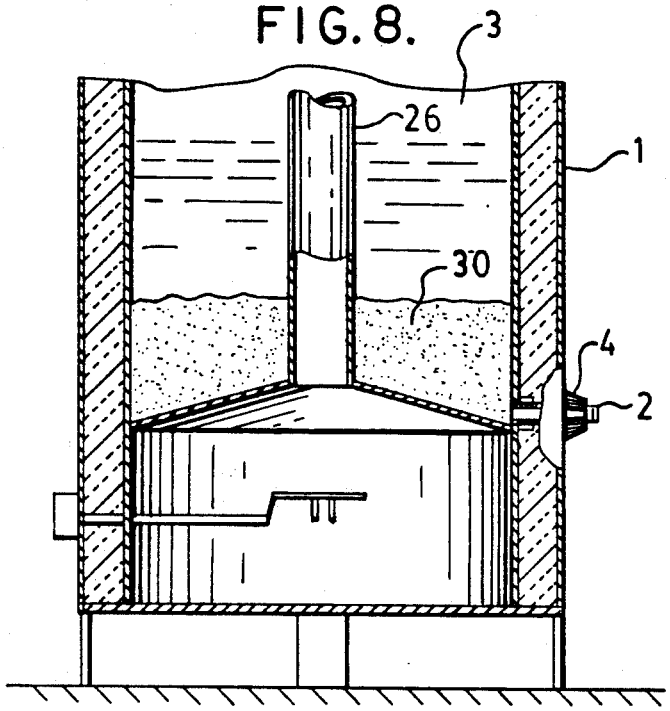
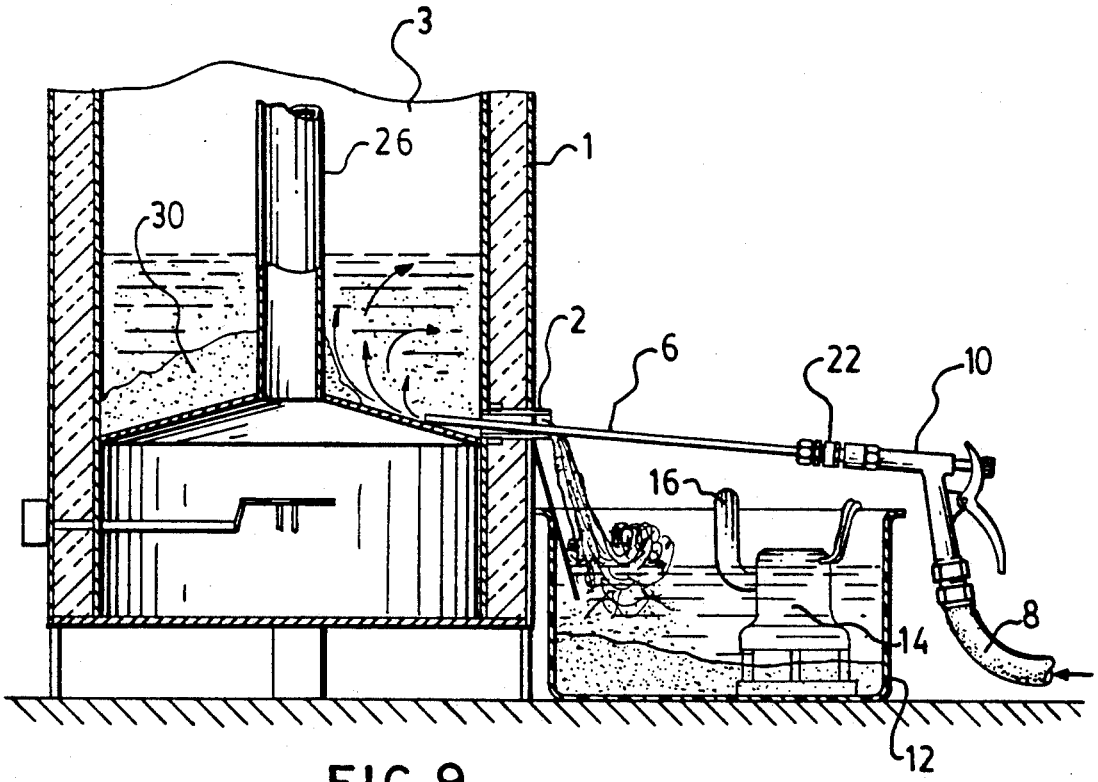
FIG. 9.

METHOD FOR REMOVAL HOT WATER HEATER · SEDIMENT

BACKGROUND OF THE INVENTION

This invention relates to hot water heaters, and more particularly to a method of removing sediment buildups therefrom and apparatus for carrying out the method.

Although the invention may be adapted for use to advantage in any hot water heater or boiler, it is primarily intended for use in conventional domestic hot water heaters, whether electric, gas-fired, or oil-burning. In most if not all models of such hot water heaters, a drain valve is provided on the sidewall of the tank, near the bottom of the tank. The invention makes use of that drain location for access to the tank to remove accumulated sediment.

In any hot water heater, sediment precipitates out of the water and tends to accumulate at the bottom of the tank. The composition of the sediment, and the degree to which it is a problem, obviously depends on the quality of the water supply.

Even where the water supply is relatively free from the minerals which make up most of the sediment, over time the sediment inevitably accumulates. Opening the drain plug periodically will serve to remove a small amount of sediment, principally that which is still in suspension near the bottom of the tank, or that which is freshly accumulated and has not had time to cake onto the bottom of the tank. However, merely opening the drain periodically only removes a very small amount of sediment, and will not result in any removal of the sediment which has caked onto the bottom of the tank.

Sediment in the bottom of the tank greatly reduces the life of a hot water heater. The primary failure mode for a domestic hot water heater is leakage, and an accumulation of sediment at the bottom of the tank is thought to be a primary cause of leaks.

The sediment shortens the water heater life, but also has adverse affects even while the hot water heater remains in service. In the case of a gas or oil-fired hot water heater, sediment at the bottom of the tank greatly reduces the efficiency, by interfering with the transfer of heat to the water. In the case of an electric hot-water heater, where the elements are immersed in the water, efficiency may not be reduced, but the overall volume of the tank may be significantly reduced, thereby affecting overall performance.

In practice, most hot water heaters are replaced when there is an excessive buildup of sediment. The home owner may not even realize that the reason for poor performance of the heater is sediment.

There is therefore a definite need, hitherto apparently unfulfilled, for some means of removing the sediment to prolong water heater life.

SUMMARY OF THE INVENTION

It is an object of the invention to provide a method for removing a substantial proportion of the sediment from the bottom of a hot water heater tank.

It is a further object to provide apparatus for implementing the method.

In the invention, the tank is drained and the drain valve is used for access to the bottom of the tank. Water jet probes, normally connected simply via a hose to a household water supply, are inserted through the drain valve opening, and are directed in such a way that the sediment is forced into suspension and runs out of the tank through the drain valve opening, around the probe.

Preferably, the water and sediment drain into a pan, and preferably a pump is provided to pump water from the pan to a drain.

Use of an air jet in place of or as a supplement to a water jet is also contemplated.

BRIEF DESCRIPTION OF THE DRAWINGS

The preferred method and the preferred embodiment of the apparatus will now be described, by way of example only, with reference to the accompanying drawings, in which:

FIG. 8 is a cross-sectional elevation view of a typical gas-fired hot-water heater, showing an accumulation of sediment;

FIG. 9 is another cross-sectional elevation view of the gas-fired hot water heater, showing the sediment being removed;

DETAILED DESCRIPTION OF THE INVENTION

Figure 1:
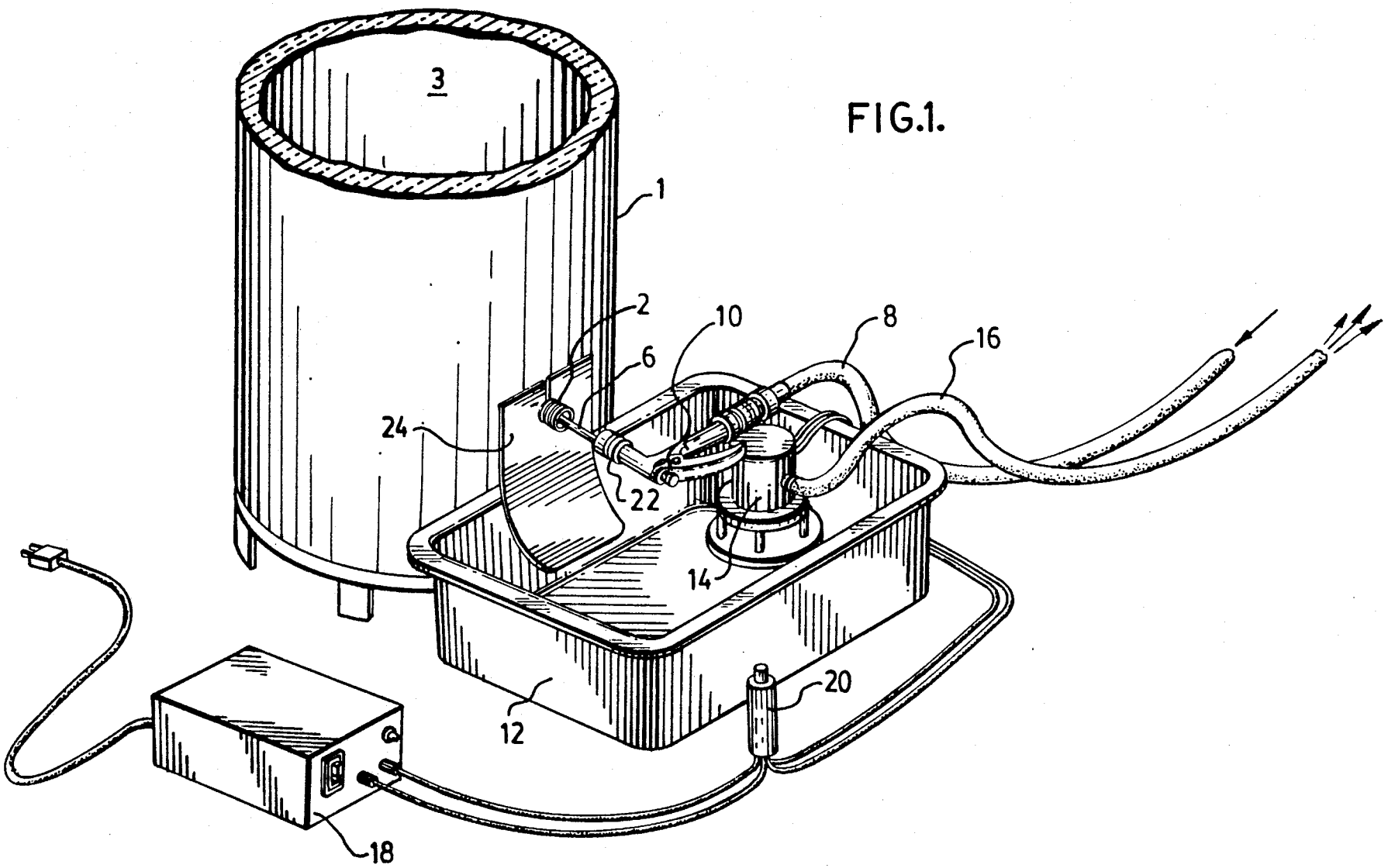
FIG. 1 is a perspective view showing a typical hot water heater tank and the preferred embodiment of the apparatus.

FIG. 1 illustrates the preferred apparatus for the invention. The hot water tank 1 has a drain tube 2 through the sidewall of the tank at the bottom of the water compartment 3, with a drain valve 4. One very common drain valve is the Masterflow (trademark) valve described in U.S. Pat. No. 3,181,555, which is readily removed simply by turning the valve counterclockwise for four complete revolutions, and then rotating the valve clockwise for six complete revolutions while pulling outwardly.

Regardless of the type of drain valve, it is a requirement that there be straight-line access into the tank via the drain tube. The method and apparatus of the invention are only applicable to tanks where that straight-line access is possible.

Once the valve 4 is removed, which of course requires that the water supply to the tank be shut off first and that the tank be drained, a water jet probe 6 is inserted through the drain tube. The water jet probe is connected to the household water supply (e.g. a hose outlet or a sink faucet having an external thread) via a supply hose 8 and a valve 10. It will be readily appreciated that any other suitable water supply could also be used. The valve is preferably a trigger-type valve, as illustrated, which facilitates easily turning the water jet on or off. The valve should include a lock so that it can be locked on for convenience. Such valves are quite well known, and it should be readily appreciated that the specific valve is not vital to the invention in any event.

A pan 12 preferably is provided to catch the water which drains from the tank during the sediment removal process. A pump 14 preferably is placed in the pan, to pump water from the pan via a ¾ inch (inside diameter) discharge hose 16 to a drain, or if necessary (e.g. in basements with no drain), up to ground level. The pump may be, for example, a 12-volt pump of the type commonly used as a marine small craft bilge pump, connected to a 12-volt power supply 18 via a push-on push-off switch 20. The power supply plugs into the regular household power supply.

If desired, a more powerful pump may be used. Obviously, adequate protection against electrical shock must be provided in such a case.

Figure 2:
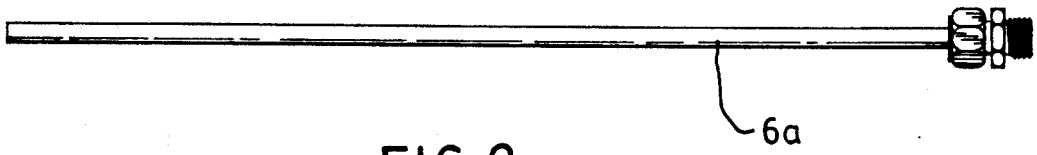
FIG. 2 is a side view of a straight probe.
Figure 3:
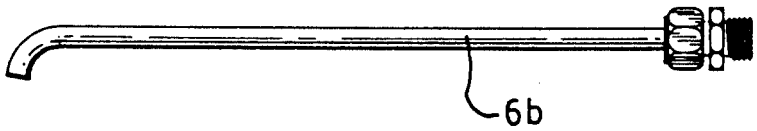
FIG. 3 is a side view of a straight probe having a bent distal end.
Figure 4:
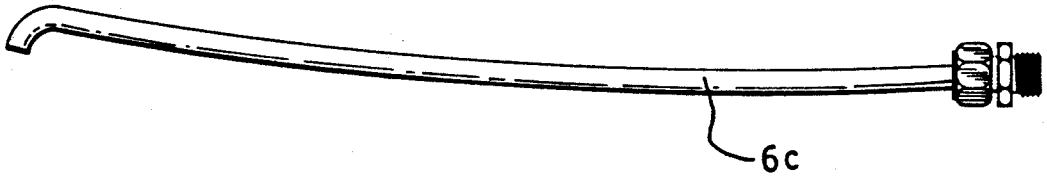
FIG. 4 is a side view of a probe which is slightly curved and which has its distal end bent back away from the direction of the curve.

FIGS. 2–4 show three variations on the probe 6, indicated by reference numerals 6*a*, 6*b*, and 6*c* respectively. Preferably, the probes are connected to the trigger valve 10 via a standard quick-disconnect fitting 22, so that they can be changed quickly and easily.

The water jet probes are inserted through the drain tube 2, and are directed in such a way that the sediment 30 is forced into suspension and runs out of the tank through the drain tube.

In detail, the method for removing sediment from gas-fired and electric hot water heaters includes the following steps:

01 For a gas-fired heater, turn the gas control to "pilot"; for an electric heater, remove the fuse.

02 Turn on the hot water tap to cool down the tank.

03 Close the cold water inlet valve to the tank.

04 Place the sediment pan 12 under drain tube outlet using the drip shield 24.

05 Place the bilge pump 14 in the sediment tray and connect it to the 12 volt power supply.

06 Connect the discharge hose 16 to the pump outlet, and route the discharge end to a sink, drain or outside.

07 Connect the rubber supply hose 8 and fittings to a faucet.

08 Open the drain valve 4 to drain the tank.

09 Remove the drain valve and open an elevated hot water tap to expedite draining.

Figure 5:
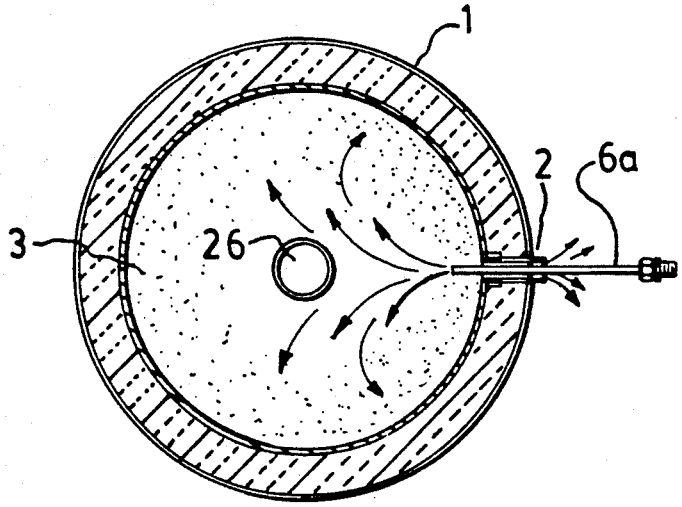
FIG. 5 is a sectional plan view of the tank, showing the first step in the preferred method.

10 Attach probe 6*a* to the quick-disconnect fitting 22, and insert it into the tank via the drain tube 2, as shown in FIG. 5, and turn on water. This action disturbs the sediment 30, starting a gravity drainage of a mixture of water and solids from the tank.

Figure 6:
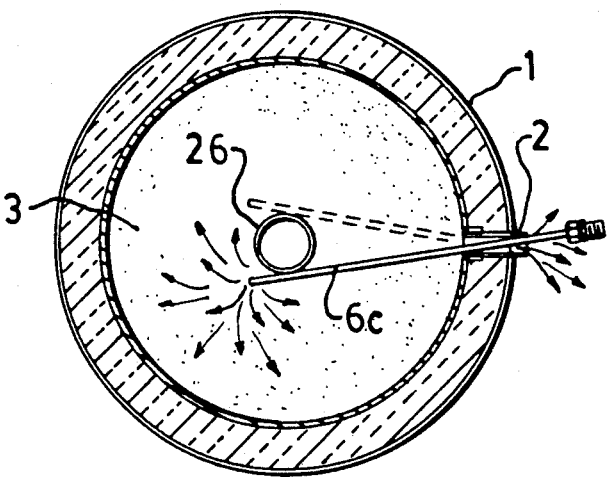
FIG. 6 is a sectional plan view of the tank, showing the second step in the preferred method.

11 Attach probe 6*c*, as shown in FIG. 6, and use to direct water jet discharge towards the bottom of the tank. This breaks up the sediment further, and again it drains from the tank. This probe is slightly curved, as illustrated, to allow for the curvature or somewhat conical shape of the bottom of the tank.

Figure 7:
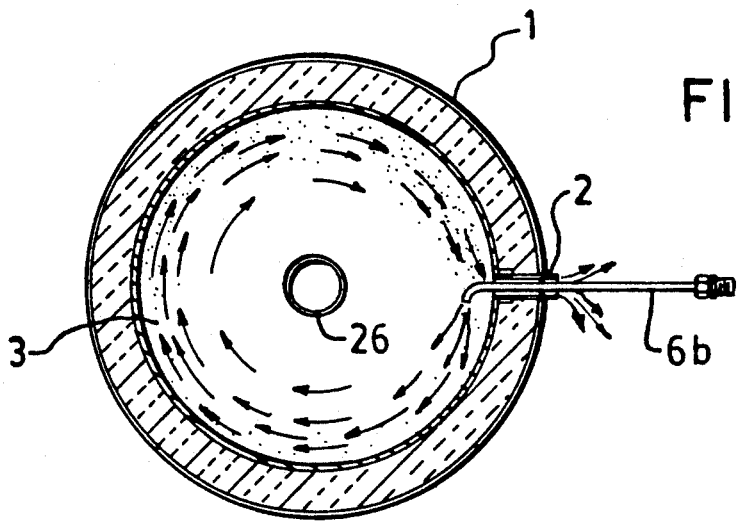
FIG. 7 is a sectional plan view of the tank, showing the third step in the preferred method.

12 Attach probe 6*b*, as shown in FIG. 7, and use to direct a stream of water in a clockwise or counterclockwise direction along the bottom circumference of the tank. This action tends to suspend solid particles in the swirling water while exiting through the drain tube around the probe.

13 Steps 10–12 are repeated until the water draining from the tank into the pan is substantially free from sediment. This may require many repetitions, and may take up to an hour or more.

14 The pump 14 may be operated intermittently or continuously as required to keep the sediment pan from overflowing.

It will be appreciated that in each of the above steps 10–12, the probe is moved around the bottom of the tank considerably and as systematically as possible, and is not merely inserted in the positions shown in FIGS. 5–7. It should also be appreciated that the exact order of the steps may obviously be varied within reason, and in particular there is no rigid sequence with respect to steps 10–12.

If there is a drain immediately adjacent the hot water heater, it may be possible to dispense with the pump, and simply allow the sediment pan to overflow to the drain. It may even be possible to dispense with the pan, and allow the sediment to flow directly down the drain with the discharged water, although using the pan and pump may be highly desirable to avoid a mess.

This procedure provides a simple and inexpensive means of removing a substantial percentage of the sediment which accumulates at the bottom of the tank.

Figure 10:
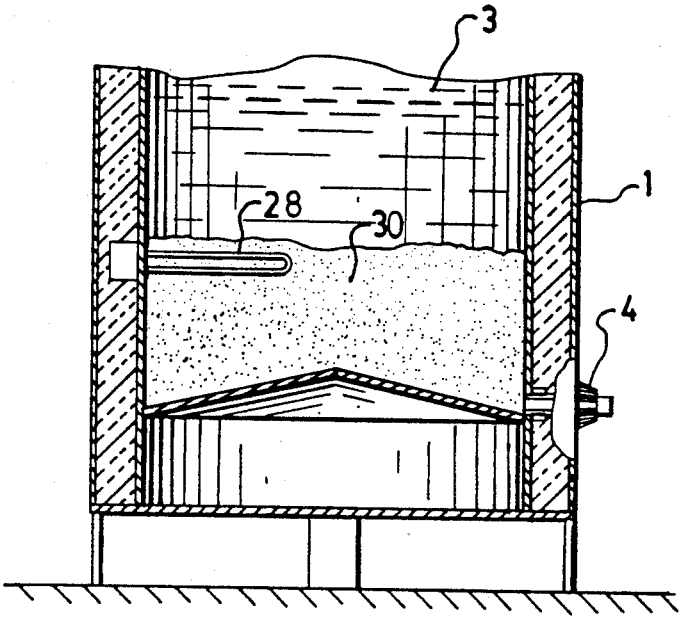
FIG. 10 is a cross-sectional elevation view of a typical electric hot water heater.
Figure 11:
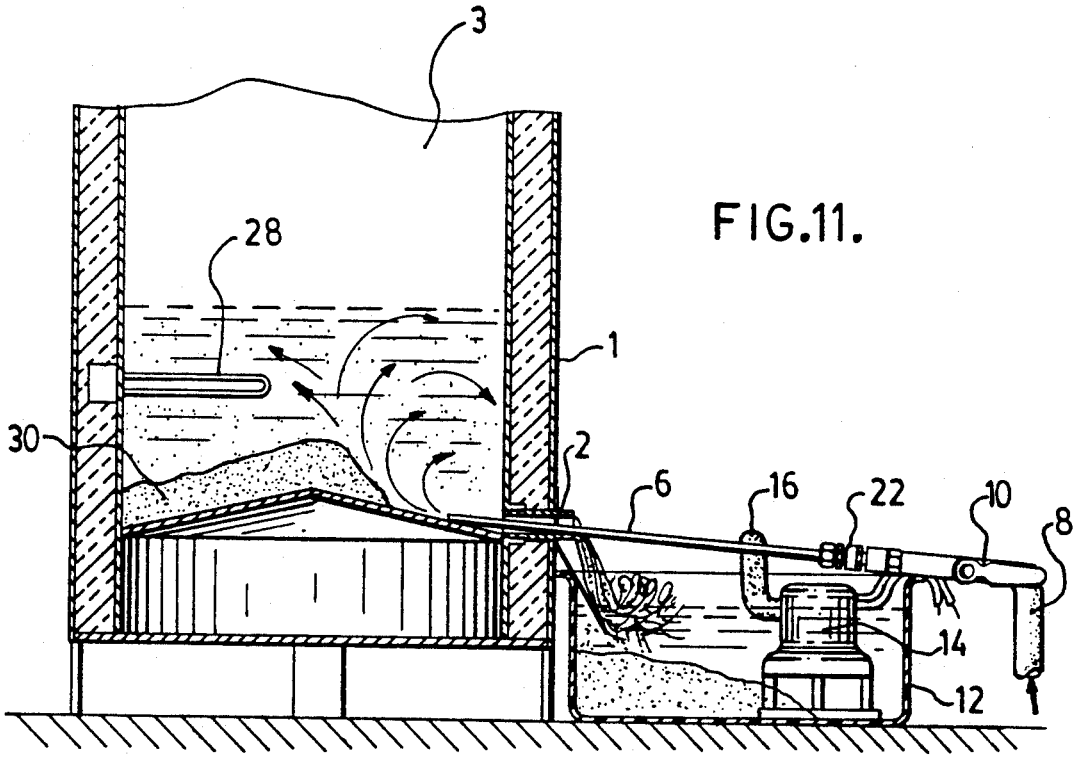
FIG. 11 is another cross-sectional elevation view of the electric hot water heater, showing the sediment being removed.

FIGS. 5–9 shown a typical gas-fired hot water heater, where there is a central flue 26 to work around, which can complicate the procedure somewhat. FIGS. 10 and 11 shown a typical electric hot water heater, where there is no central flue, with a lower heating element 28.

During the cleaning process, the water jet injects a substantial volume of water, which gradually rises in the tank, since not as much water can drain out of the water around the probe. Periodically, in may be necessary to stop injecting water to allow water to drain from the tank. This may offer a convenient time to change probes.

Use of an air jet in place of or as a supplement to a water jet is also contemplated. Compressed air could be used, for example, and routed through the probe to dislodge the sediment, and then water could be used to flush the sediment out as described above.

Other variations on the system will be apparent to those knowledgable in the field, and such obvious variations are intended to be included in the scope of the invention as defined by the following claims, whether or not expressly described above.

What is claimed as the invention is:

1. A method of removing sediment from the bottom of the tank of a hot water heater including water heating means, where said tank has a drain valve on a straight drain tube through a sidewall near the bottom of the tank, said method comprising the steps of:

turning off the water heating means and the supply of water to the hot water heater;

opening said drain valve to drain the water from said tank;

removing said drain valve if necessary to provide straight-line access to said tank through said drain tube;

connecting a water-jet probe to a water supply and inserting said probe into said tank through said drain tube;

turning on said water supply to direct a jet of water through said probe, and directing said jet towards said sediment, said water and sediment being permitted to drain from said tank around said probe and through said drain tube;

moving said probe around the bottom area of said tank to force said sediment into suspension in said water, and continuing to allow said water and sediment to drain from said tank until said water is substantially free from sediment.

2. A method as recited in claim 1, further comprising, prior to the step of opening said drain valve to drain water from said tank, the step of positioning a sediment pan adjacent said hot water heater and under said drain tube, to catch water and sediment running from said drain tube.

3. A method as recited in claim 2, further comprising the step of placing a pump in said sediment pan to pump water from said pan to a remote discharge location.

4. A method as recited in claim 1, wherein said step of directing said jet towards said sediment comprises the sub-steps of first directing a jet generally horizontally across the tank to disturb loose sediment, then after a time directing a jet generally downwardly to break up more solid sediment, and moving said downwardly directed jet around the bottom of the tank, and then after a time directing a jet generally horizontally along the bottom circumference of the tank.

5. A method as recited in claim 4, comprising numerous repetitions of said sub-steps until said tank is substantially free from sediment.

6. A method as recited in claim 4, further comprising, prior to the step of opening said drain valve to drain water from said tank, the step of positioning a sediment pan adjacent said hot water heater and under said drain tube, to catch water and sediment running from said drain tube.

7. A method as recited in claim 6, further comprising the step of placing a pump in said sediment pan to pump water from said pan to a remote discharge location.

8. A method as recited in claim 5, further comprising, prior to the step of opening said drain value to drain water from said tank, the step of positioning a sediment pan adjacent said hot water heater and under said drain tube, to catch water and sediment running from said drain tube.

9. A method as recited in claim 8, further comprising the step of placing a pump in said sediment pan to pump water from said pan to a remote discharge location.

* * * * *